US006863317B2

(12) United States Patent
Alton et al.

(10) Patent No.: US 6,863,317 B2
(45) Date of Patent: Mar. 8, 2005

(54) LATCH ASSEMBLY

(75) Inventors: Darrel M. Alton, Royal Oak, MI (US); James M. Stanick, Rochester Hills, MI (US); Todd H. Fast, Huntington Woods, MI (US); James Herbert Shoemaker, White Lake, MI (US)

(73) Assignee: General Motors Corporation, Detroit, MI (US)

( * ) Notice: Subject to any disclaimer, the term of this patent is extended or adjusted under 35 U.S.C. 154(b) by 11 days.

(21) Appl. No.: 10/400,857

(22) Filed: Mar. 27, 2003

(65) Prior Publication Data

US 2004/0189013 A1 Sep. 30, 2004

(51) Int. Cl.[7] ..... E05C 1/06

(52) U.S. Cl. ..... 292/144; 292/177; 292/201; 292/DIG. 23; 292/DIG. 61

(58) Field of Search ..... 292/144, 138, 292/177, 183, 201, DIG. 23, DIG. 61

(56) References Cited

U.S. PATENT DOCUMENTS

| | | | | | |
|---|---|---|---|---|---|
| 350,312 | A | * | 10/1886 | Markland | 292/144 |
| 816,792 | A | * | 4/1906 | Green et al. | 292/144 |
| 1,199,199 | A | * | 9/1916 | Mason | 292/201 |
| 1,417,430 | A | * | 5/1922 | Tulloch et al. | 292/201 |
| 1,703,077 | A | * | 2/1929 | Wethling | 70/240 |
| 2,034,971 | A | * | 3/1936 | Brockway | 292/340 |
| 2,081,055 | A | * | 5/1937 | Kiracofe | 292/201 |
| 2,647,789 | A | * | 8/1953 | Chayne | 49/383 |
| 2,763,888 | A | * | 9/1956 | Billeter | 16/59 |
| 2,927,811 | A | * | 3/1960 | Rea et al. | 292/164 |
| 3,090,644 | A | * | 5/1963 | Fiala et al. | 292/229 |
| 3,135,541 | A | * | 6/1964 | Kwasek | 292/64 |
| 3,199,153 | A | * | 8/1965 | Weinstein | 49/379 |
| 3,624,761 | A | * | 11/1971 | Kohn | 180/289 |
| 3,751,086 | A | * | 8/1973 | Geringer | 292/144 |
| 3,797,882 | A | * | 3/1974 | Brimhall | 296/190.06 |
| 3,848,907 | A | * | 11/1974 | Shiurila | 292/81 |
| 3,937,505 | A | * | 2/1976 | Dempsey | 292/201 |
| 3,942,828 | A | * | 3/1976 | Bourrie et al. | 292/201 |
| 4,030,322 | A | * | 6/1977 | Pettit | 70/159 |
| 4,088,354 | A | * | 5/1978 | Kolendowicz | 292/201 |
| 4,354,699 | A | * | 10/1982 | Logan | 292/201 |
| 4,428,607 | A | * | 1/1984 | Levine | 292/201 |
| 4,470,625 | A | * | 9/1984 | Walsh et al. | 292/201 |
| 4,677,834 | A | * | 7/1987 | Hicks | 70/279.1 |
| 4,691,542 | A | * | 9/1987 | Young | 70/129 |
| 4,691,948 | A | * | 9/1987 | Austin et al. | 292/171 |
| 4,796,932 | A | * | 1/1989 | Tame | 292/112 |
| 4,993,757 | A | * | 2/1991 | Corzine | 292/144 |
| 6,241,294 | B1 | * | 6/2001 | Young et al. | 292/336.3 |

* cited by examiner

*Primary Examiner*—Daniel P. Stodola
*Assistant Examiner*—Carlos Lugo
(74) *Attorney, Agent, or Firm*—Laura C. Hargitt

(57) ABSTRACT

A latch assembly for a swinging panel hinged to a vehicle body includes a latch body that is adapted to be attached to the vehicle body, a striker adapted to be attached to the swinging panel and engage the latch body in a closed position of the swinging panel, and a lever having first and second ends. The lever is pivotably attached to the latch body at a pivot point intermediate the first and second ends. The first end of the lever is operable to engage the striker. The latch assembly also includes a spring having one end attached to the lever between the second end and the pivot point and an opposite end fixed relative to the latch body for rotating the lever about the pivot point. A solenoid is attached to the second end of the lever. The solenoid is operable to rotate the lever about the pivot point to move the first end of the lever from a panel unlatched position to a panel latched position.

14 Claims, 3 Drawing Sheets

LATCH ASSEMBLY

BACKGROUND OF THE INVENTION

The present invention relates generally to latch assemblies and, in particular, to a latch assembly for latching a swinging panel hinged to a vehicle body.

Latch assemblies for vehicle swinging panels, such as vehicle doors and lift gates that are hinged to a vehicle body, are well known. A typical prior art latch assembly includes an elongated striker member that is attached to and extends outwardly from a surface of the swinging panel. A hatch latch is attached to the vehicle body. The hatch latch includes a latch throat that is adapted to receive the striker when the swinging panel is closed to lock the striker therein.

Many prior art latch assemblies utilize a pop-up feature for the swinging panel, such as for rear hatches, hoods, and four-bar hinged deck lids, among others. The pop-up feature typically includes a compression spring that cooperates with a lever to open the swinging panel when the striker member is released from the hatch latch. In order to close the swinging panel, the spring must again be compressed, which provides a disadvantageously high force that a customer must overcome with a correspondingly higher closing effort. This high closing effort is a continuing source of customer dissatisfaction and warranty claims.

It is desirable, therefore, to provide a latch assembly that reduces the amount of force required to close a swinging panel to reduce customer dissatisfaction and warranty claims while not reducing the functionality of the latch assembly.

SUMMARY OF THE INVENTION

The present invention concerns a latch assembly for a swinging panel hinged to a vehicle body. The latch assembly includes a latch body that is adapted to be attached to the vehicle body, a striker adapted to be attached to the swinging panel and engage the latch body in a closed position of the swinging panel, and a lever having first and second ends. The lever is pivotably attached to the latch body at a pivot point intermediate the first and second ends. The first end of the lever is operable to engage the striker. The latch assembly also includes a spring having one end attached to the lever between the second end and the pivot point and an opposite end fixed relative to the latch body for rotating the lever about the pivot point. The spring is preferably a tension spring. A solenoid is attached to the second end of the lever. The solenoid is operable to rotate the lever about the pivot point to move the first end of the lever from a panel unlatched position to a panel latched position.

When the latch body is attached to the vehicle body and the striker is attached to the swinging panel and engaged with the latch body, the spring applies a force to rotate the lever engaging the first end of the lever with the striker to move the striker away from the latch body and pop-up the swinging panel. When the solenoid is activated, the solenoid overcomes the force applied by the spring and rotates the first end of the lever away from the striker to permit the striker to engage with the latch body to close the swinging panel.

Alternatively, the latch assembly does not include a spring, and the solenoid is utilized as a push and pull mechanism. In this embodiment, the solenoid is attached directly to the lever without the use of a spring in order to pull and push on the lever and actuate the lever to pop open and permit closure respectively of the swinging panel.

The latch assembly according to the present invention advantageously adds a solenoid assembly to a conventional latch assembly. The latch assembly according to the present invention provides for significantly reduced closing efforts for swinging panels that require a pop-up feature such as hatches, hoods, and four-bar hinged deck lids, among others. The latch assembly also provides an increased finger clearance for panels that require a pop-up type feature for the latch or striker, which is a customer satisfier.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
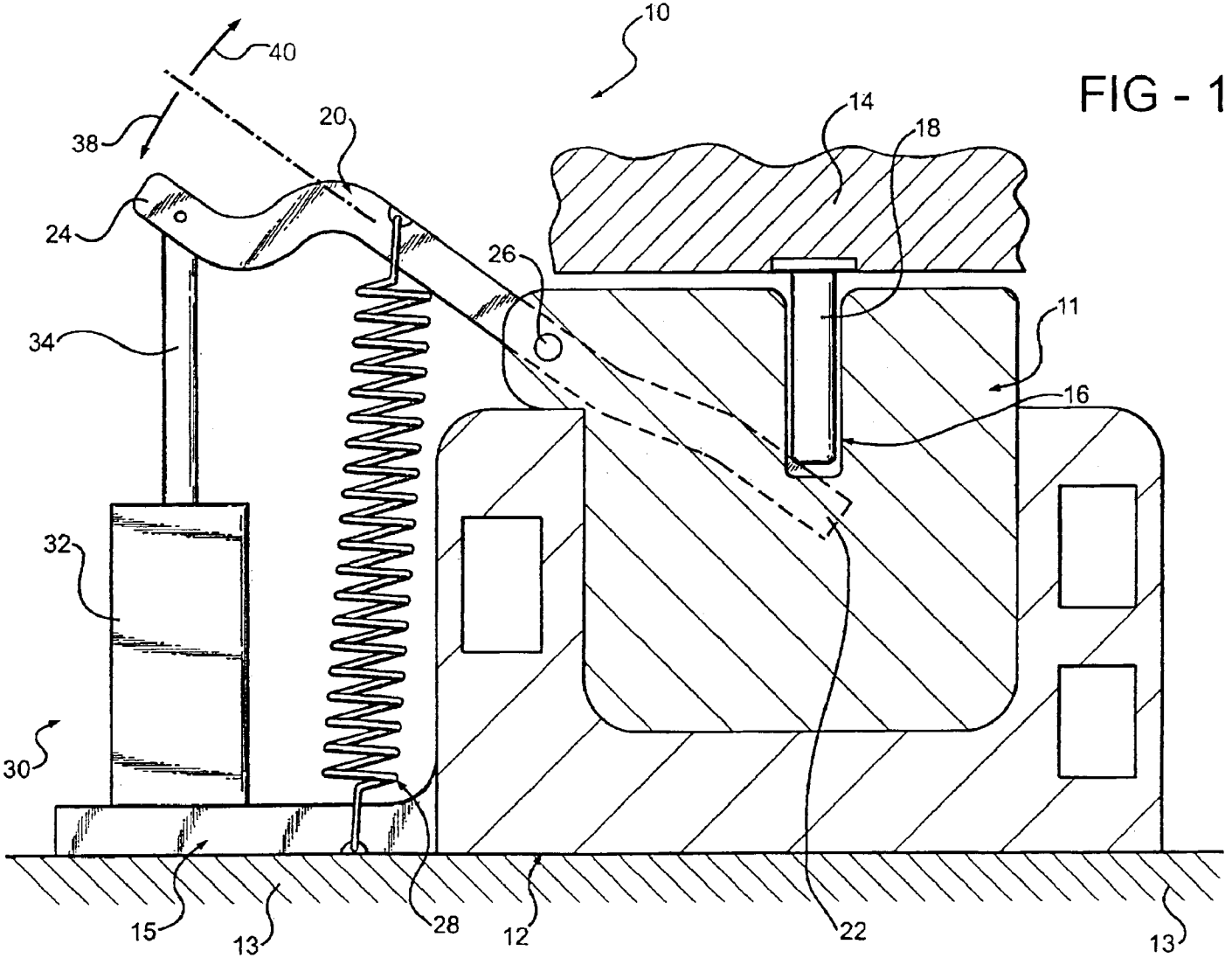
FIG. 1 is a schematic view of a latch assembly in accordance with the present invention shown in a panel latched position.

Referring now to FIG. 1, a latch assembly in accordance with the present invention is indicated generally at 10 and is shown in a panel latched position, discussed in more detail below. The latch assembly 10 includes a latch body 12 that is adapted to be attached to a vehicle body 13 having hinged thereto a swinging panel 14, such as a vehicle door, a vehicle lift gate or the like. An upper portion 11 of the latch body 12 defines a latch throat 16 therein. The latch throat 16 is adapted to receive a striker member 18 that is attached to and extends from the swinging panel 14. A support bracket 15 extends outwardly from a lower portion of the latch body 12 and is attached to the lower portion of the latch body 12 and the vehicle body 13. A latch mechanism (not shown) in the latch throat 16 releasably retains the striker member 18 and the swinging panel 14 to the latch body 12 and the vehicle body 13. Alternatively, the latch body 12 is adapted to be attached to the swinging panel 14 and the striker member 18 attaches to and extends from the vehicle body 13.

A lever 20 having a first end 22 and a second end 24 is pivotably attached to the latch body 12 at a pivot point 26 intermediate the first end 22 and the second end 24. The first end 22 of the lever 20 is operable to engage a lower portion of the striker member 18. A spring member 28 is attached at one end to the lever 20 between the second end 24 and the pivot point 26. The spring member 28 is preferably a tension spring. An opposite end of the spring member 28 is attached to the support bracket 15 and is fixed relative to the latch body 12 for rotating the lever 20 about the pivot point 26 in a latch opening direction indicated by an arrow 38.

A solenoid assembly 30 includes a solenoid body 32 having a plunger 34 extending therefrom. The solenoid body 32 is attached to the support bracket 15 outboard of the spring member 28. A free end of the plunger 34 is attached to the second end 24 of the lever 20. The solenoid assembly 30 is operable to move the plunger 34 between an extended position with the plunger 34 spaced away from an upper surface of the solenoid body 32, shown in FIG. 1, and a retracted position, discussed in more detail below. By virtue of the connection of the plunger 34 and the second end 24 of the lever 20, the solenoid assembly 30 is operable to rotate the lever 20 about the pivot point 26 in a closing direction indicated by an arrow 40 and move the first end 22 of the lever 20 from a panel unlatched position to a panel latched position. The panel latched position corresponds to the extended position of the plunger 34. The spring member 28 is in tension in the panel unlatched position, providing a force tending to rotate the lever 20 in the opening direction 38.

Figure 2:
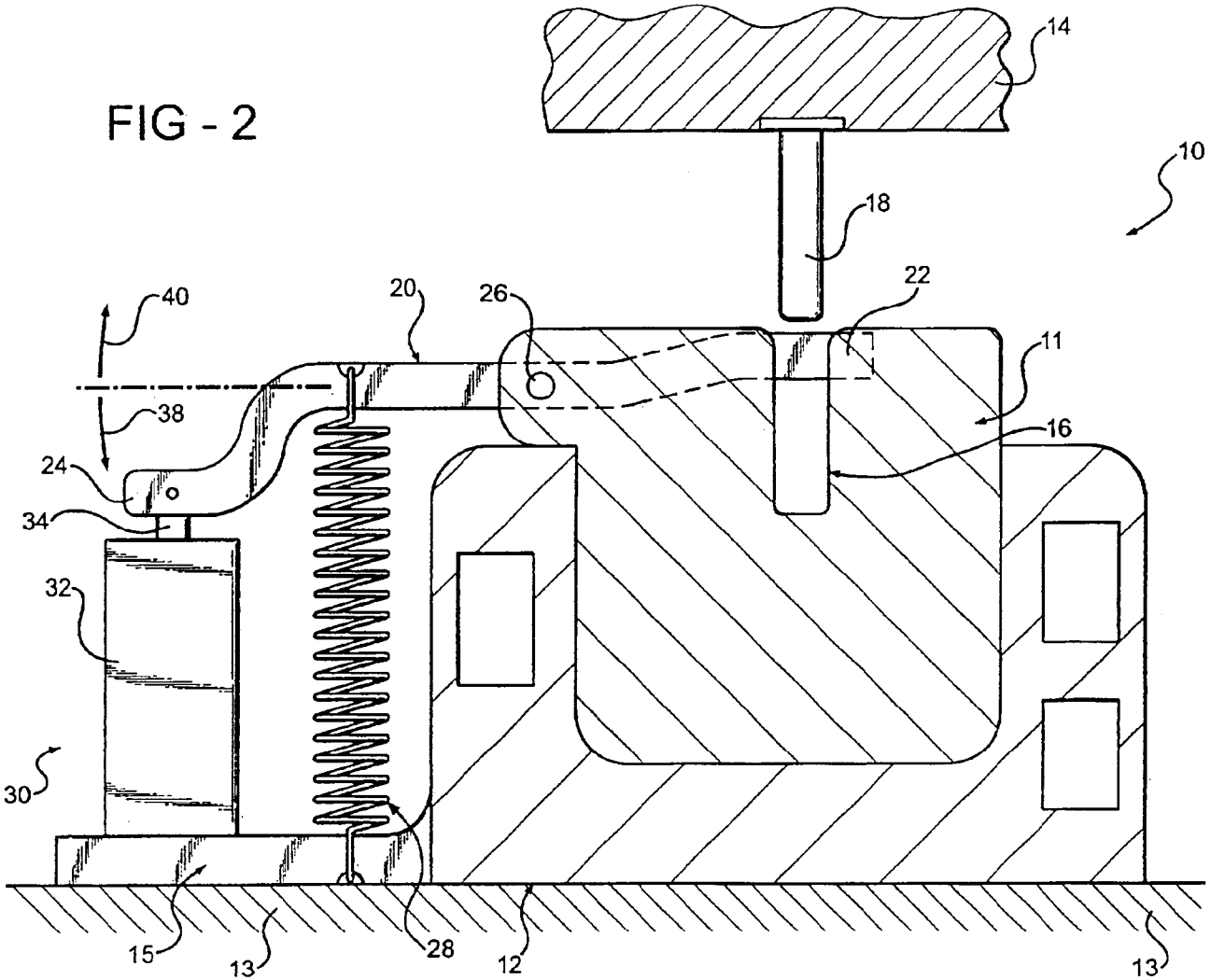
FIG. 2 is a schematic view of the latch assembly of FIG. 1 shown in a panel unlatched position.

Referring now to FIG. 2, the latch assembly 10 is shown in a panel unlatched position. The panel unlatched position corresponds to the retracted position of the plunger 34. In the panel unlatched position, the solenoid plunger 34 is in the retracted position with the plunger 34 extending a short distance from the upper surface of the solenoid body 32. The striker member 18 is not received in the latch throat 16, the first end 22 of the lever 20 is not engaged with the striker member 18, and the spring member 28 is at rest. The swinging panel 14 is not retained to the vehicle body 13 because the striker member 18 is not retained by the latch mechanism in the latch throat 16.

The solenoid assembly 30 is preferably connected to a controller (not shown), which is operable to send an electrical signal to activate and deactivate the solenoid assembly 30. Preferably, the controller receives an electrical signal from a switch (not shown) or the like when the striker 18 is moved adjacent to the latch body 12. The controller then sends an electrical signal to activate the solenoid assembly 30, which moves the plunger 34 from the retracted position to the extended position.

Referring now to FIGS. 1 and 2, in operation, the latch assembly 10 is in the panel latched position of FIG. 1 when the latch body 12 is attached to the swinging panel 14 and the striker 18 is attached to the vehicle body 13 and engaged with the latch mechanism in the latch throat 16. When the latch mechanism in the latch throat 16 is disengaged, the spring 28 applies a force to rotate the lever 20 in the opening direction 38, which engages the first end 22 of the lever 20 with the striker 18. When the first end 22 engages the striker 18, the striker 18 moves away from the latch body 12 and pops-up the swinging panel 14, moving the latch assembly 10 from the panel latched position to the panel unlatched position of FIG. 2. Because the spring 28 in the panel unlatched position is at rest, moving the first end 22 of the lever 20 in the closing direction 40 is difficult because this movement is resisted by the spring 28.

When the latch assembly 10 is in the panel unlatched position of FIG. 2, the swinging panel 14 is about to be closed, and the striker 18 is moved adjacent to the latch body 12, the switch is activated and the controller sends an electrical signal to activate the solenoid assembly 30. When activated, the solenoid assembly 30 moves the plunger 34 from the retracted position to the extended position and moves the spring 28 from the rest position by rotating the first end 22 of the lever 20 away from the striker 18 in the closing direction 40 to permit the striker 18 to engage with the latch mechanism in the latch throat 16 and to close the swinging panel 14. Because the solenoid assembly 30 moves the spring 28 to the extended position, the force required to close the swinging panel 14 to the vehicle body 13 is much less than if the spring 28 was being tensioned while the swinging panel was closed, as in prior art latch assemblies. After the striker 18 is engaged with the latch mechanism in the latch throat 16, the switch is deactivated and the controller stops sending an electrical signal to the solenoid assembly 30, deactivating the solenoid assembly 30. The plunger 34 remains in the extended position until the latch assembly 10 is released. Alternatively, the latch assembly 10 does not include an external spring member 28 and the solenoid body 32 includes an internal spring (not shown) that replaces the functionality of the spring member 28 to move the lever 20 about the pivot point 26.

Figure 3:
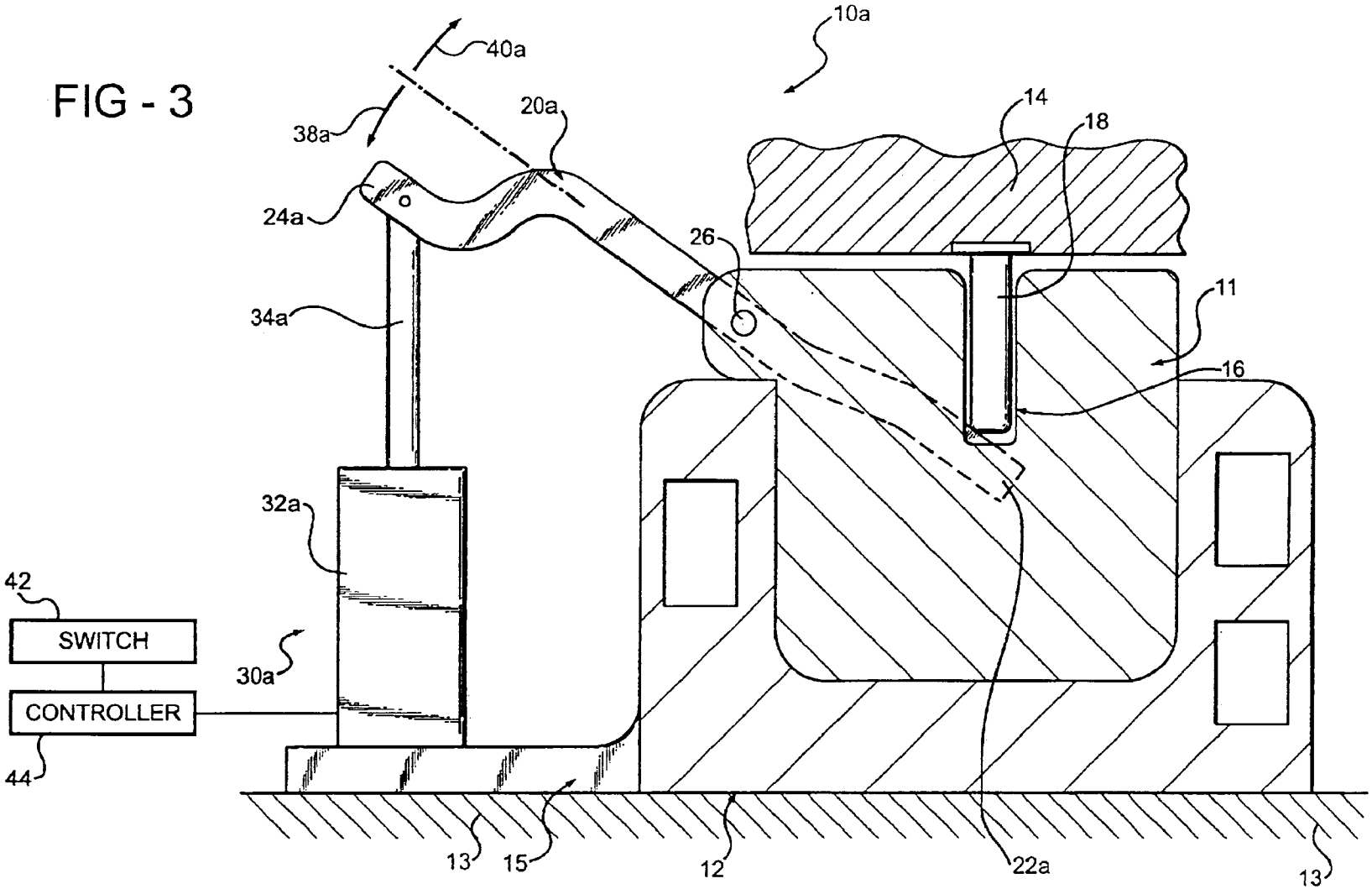
FIG. 3 is a schematic view of an alternative embodiment of a latch assembly in accordance with the present invention shown in a panel latched position.

Referring now to FIG. 3, an alternative embodiment of a latch assembly in accordance with the present invention is indicated generally at 10*a*. In this embodiment, elements similar to those shown in the previous embodiment are designated with a lowercase "a". The latch assembly 10*a* is shown in a panel latched position, similar to FIG. 1, and includes a solenoid assembly 30*a*. The solenoid assembly 30*a* is operable to move the lever 20*a* in both the opening direction 38*a* and the closing direction 40*a*, which allows the solenoid assembly 30*a* to replace the functionality of the spring member 28 of FIGS. 1 and 2 in order to open and close the swinging panel 14. Preferably, the solenoid assembly 30*a* is used as a push and pull mechanism. The solenoid assembly 30*a* is preferably a double-acting solenoid that is operable to move the plunger 34*a* to an extended position, shown in FIG. 3, and to a retracted position (not shown), similar to the retracted position of the latch assembly 10 in FIG. 2.

In operation, the latch assembly 10*a* is in the panel latched position of FIG. 3 when the latch body 12 is attached to the swinging panel 14 and the striker 18 is attached to the vehicle body 13 and engaged with the latch mechanism in the latch throat 16. When the latch mechanism in the latch throat 16 is disengaged, a switch 42 activates a controller 44 that sends an electrical signal to activate the solenoid assembly 30*a*. The solenoid assembly 30*a*, when activated, moves the plunger 34*a* from the extended position to the retracted position, rotating the lever 20*a* in the opening direction 38*a*, which engages the first end 22*a* of the lever 20 with the striker 18. When the first end 22*a* engages the striker 18, the striker 18 moves away from the latch body 12 and pops-up the swinging panel 14, moving the latch assembly 10*a* from the panel latched position to a panel unlatched position, similar to that of FIG. 2.

When the latch assembly 10*a* is in the panel unlatched position similar to that of FIG. 2, the swinging panel 14 is about to be closed, and the striker 18 is moved adjacent to the latch body 12, the switch 42 is activated and the controller 44 sends an electrical signal to activate the solenoid assembly 30*a*. When activated, the solenoid assembly 30*a* moves the plunger 34*a* from the retracted position to the extended position and rotates the first end 22*a* of the lever 20*a* away from the striker 18 in the closing direction 40*a* to permit the striker 18 to engage with the latch mechanism in the latch throat 16 and to close the swinging panel 14. After the striker 18 is engaged with the latch mechanism in the latch throat 16, the switch 42 is deactivated and the controller 44 stops sending an electrical signal to the solenoid assembly 30*a*, deactivating the solenoid assembly 30*a*.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A latch assembly for a swinging panel hinged to a vehicle body comprising:

a latch body adapted to be attached to a one of a vehicle body and a swinging panel hinged to the vehicle body;

a striker adapted to be attached to another one of the vehicle body and the swinging panel and engage said latch body in a closed position of the swinging panel;

a lever having first and second ends, said lever being pivotably attached to said latch body at a pivot point intermediate said first and second ends, said first end of said lever operable to engage said striker;

a spring having one end attached to said lever between said second end and said pivot point and an opposite end fixed relative to said latch body, said spring operable to apply a force to rotate said lever about said pivot point in an opening direction and cause relative movement between the vehicle body and the swinging panel; and a solenoid attached to said second end of said lever, said solenoid, when activated, operable to overcome said force applied by said spring and rotate said first end of said lever about said pivot point in a closing direction to permit said striker to engage with said latch body.

2. The latch assembly according to claim 1 wherein said solenoid is attached to a support bracket extending from said latch body.

3. The latch assembly according to claim 2 wherein said opposite end of said spring is attached to said support bracket extending from said latch body.

4. The latch assembly according to claim 1 wherein said latch body is adapted to be attached to the swinging panel and said striker is adapted to be attached to the vehicle body.

5. The latch assembly according to claim 1 wherein said striker is adapted to be attached to the swinging panel and said latch body is adapted to be attached to the vehicle body.

6. A latch assembly for a swinging panel hinged to a vehicle body comprising;

a latch body adapted to be attached to a vehicle body;

a striker adapted to be attached to a swinging panel hinged to the vehicle body and engage said latch body in a closed position of the swinging panel;

a lever having first and second ends, said lever being pivotably attached to said latch body at a pivot point intermediate said first and second ends, said first end of said lever operable to engage the striker; and a solenoid attached to said second end of said lever, said solenoid operable to rotate said lever about said pivot point to move said first end of said lever in a first direction to move said striker away from said latch body and pop-up the swinging panel, said solenoid operable to rotate said lever about said pivot point in a second direction to move said first end of said lever away from said striker to permit said striker to engage with said latch body and close the swinging panel when said striker is moved adjacent to said latch body.

7. The latch assembly according to claim 6 including a controller operable to activate and deactivate said solenoid.

8. The latch assembly according to claim 7 including a switch operable to send a signal to said controller to activate and deactivate said solenoid.

9. The latch assembly according to claim 6 wherein said solenoid is attached to a support bracket extending from said latch body.

10. A latch assembly for a swinging panel hinged to a vehicle body comprising:

a latch body adapted to be attached to a one of a vehicle body and a swinging panel hinged to the vehicle body;

a striker adapted to be attached to another one of the vehicle body and the swinging panel and engage said latch body in a closed position of the swinging panel;

a lever having first and second ends, said lever being pivotably attached to said latch body at a pivot point intermediate said first and second ends, said first end of said lever operable to engage the striker;

a first actuator means connected to said lever at a point between said second end and said pivot point and fixed relative to said latch body, said first actuator means operable to rotate said lever about said pivot point in a first direction and move said striker away from said latch body; and a second actuator means connected to said second end of said lever and fixed relative to said latch body, said second actuator means operable to rotate said lever about said pivot point in a second direction to move said first end of said lever from a swinging panel unlatched position to a swinging panel latched position and permit said striker to engage with said latch body and close the swinging panel when said striker is moved adjacent to said latch body.

11. The latch assembly according to claim 10 wherein said first actuator means is a spring and said second actuator means is a solenoid.

12. The latch assembly according to claim 10 wherein said first and second actuator means is a push-pull solenoid.

13. The latch assembly according to claim 10 wherein said latch body is adapted to be attached to the swinging panel and said striker is adapted to be attached to the vehicle body.

14. The latch assembly according to claim 10 wherein said striker is adapted to be attached to the swinging panel and said latch body is adapted to be attached to the vehicle body.

* * * * *